United States Patent [19]

Edwards

[11] 3,977,852

[45] Aug. 31, 1976

[54] COMPRESSOR-EXPANDER WITH VOLUME COMPENSATION

[75] Inventor: Thomas C. Edwards, Casselberry, Fla.

[73] Assignee: The Rovac Corporation, Maitland, Fla.

[22] Filed: Apr. 2, 1975

[21] Appl. No.: 564,439

[52] U.S. Cl. ..... 62/402

[51] Int. Cl.[2] ..... F25D 9/00

[58] Field of Search ..... 62/402, 86; 418/13; 417/392, 406

[56] References Cited

UNITED STATES PATENTS

| | | | |
|---|---|---|---|
| 2,733,663 | 2/1956 | Marshall | 417/406 |
| 3,686,893 | 8/1972 | Edwards | 62/402 |
| 3,752,605 | 8/1973 | Newton | 418/13 |

FOREIGN PATENTS OR APPLICATIONS

| | | |
|---|---|---|
| 655,201 | 10/1935 | Germany |

*Primary Examiner*—Lloyd L. King

*Attorney, Agent, or Firm*—Leydig, Voit, Osann, Mayer & Holt, Ltd.

[57] ABSTRACT

A compressor-expander having a vaned rotor eccentrically mounted in a cylindrical chamber to define a series of compartments which vary in volume through volumetric stages which are maximum, convergent, minimum and divergent. The compressor-expander has an associated heat exchanger connected to heat exchanger ports at the convergent and divergent stages and spaced inlet and outlet ports at the maximum stage. Means are provided for inducing, or blowing, warm air through the successively presented compartments at the maximum stage to achieve a scavenged discharge of cool air to recharge each compartment with warm air. Preferably the flow is induced by a high pressure jet which entrains air in the air stream to produce an amplified flow, the compressed air being bled from the cold end of the heat exchanger. A valve is interposed in the bleed line to coordinate the rate of bleed either manually or automatically with the rotor speed or the operating conditions, primarily pressure, existing in the heat exchanger. Where the rotor speed is subject to variation over wide limits, as in automotive usage, a relief type valve may be used. Alternatively, a blower is used to induce air flow, the blower being driven from the rotor shaft. As a still further alternative the blower may be separately driven and the air stream controllingly throttled to vary the rate of discharge of air into the cooled space. In any event, the rate of flow of warm air in the scavenging stream may exceed the rate of production of cold air in the rotor compartments so that air is discharged into the cooled space at a tempered, more comfortable level. A thermostat in the space, or in the air stream which cools the space, acts correctively to control the flow of air in the stream or to control the speed at which time rotor is driven thereby to control BTU rate.

37 Claims, 23 Drawing Figures

71
91
90
51
95
41
52
92
48
22
23
58
30
98
42
47
102
53
35
e
57
43
34
34a
46
100
54
20
28
44
63
26
81a
61
82a
55
45
56
101
81
82
2
2
83

21
86
3
d1
d2
87
72
84
3
41
48
85
58

74
73
86
72
27
25
4
41
21
48
85
4

7
93
94
95
21
97
73
92
91
96
71
72
90
20
98
7
PRIME MOVER
SPEED ADJUST
(OPTIONAL)
102
31
100
61
62
33
32
63
64
22
49
28
101
26
24
30
21
25
27

90a
97a
92a
98a

Fig. 8.
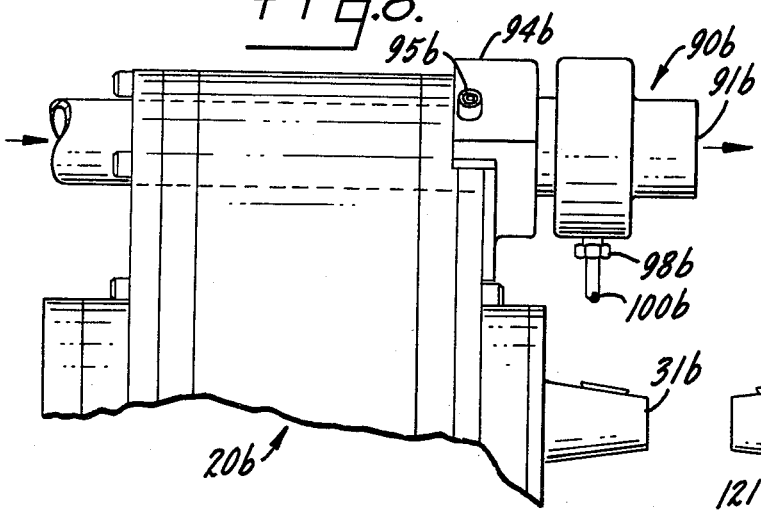
Fig. 10.
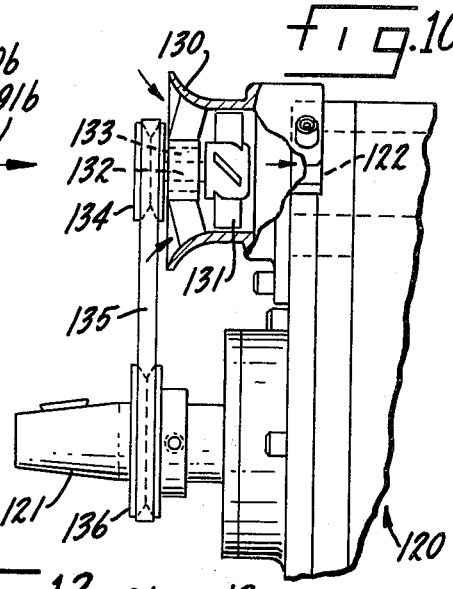
Fig. 9.
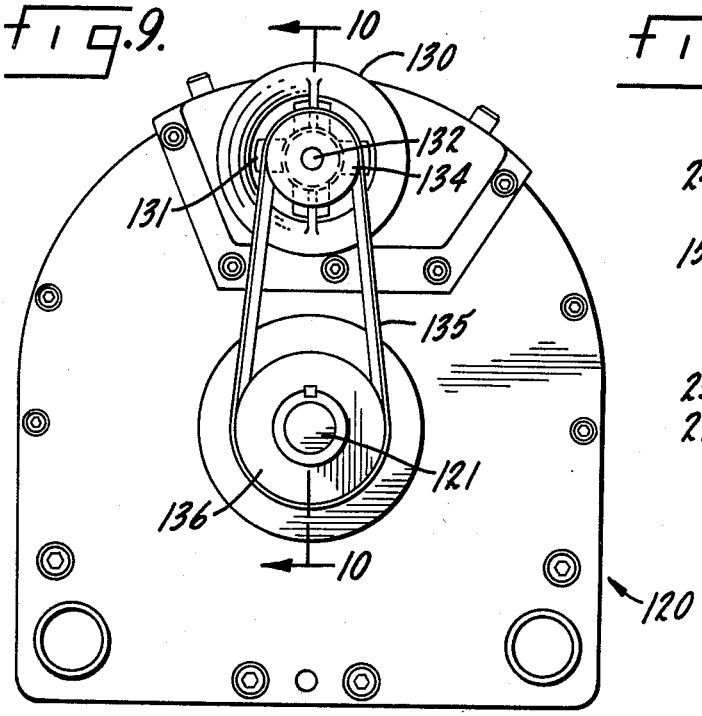
Fig. 12.
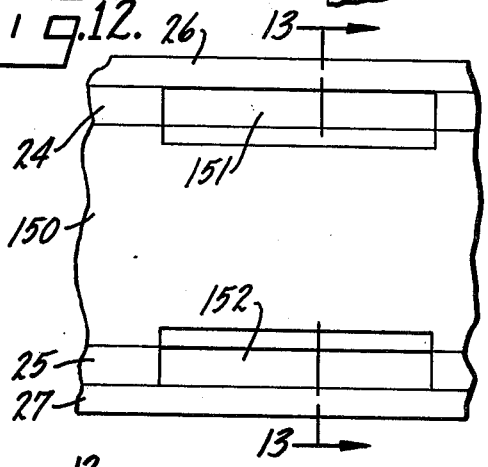
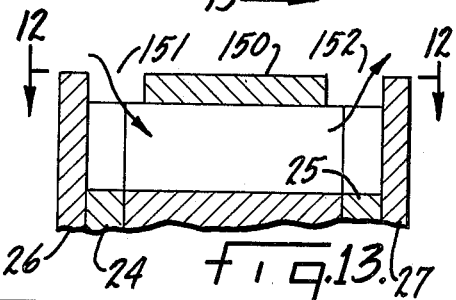
Fig. 13.
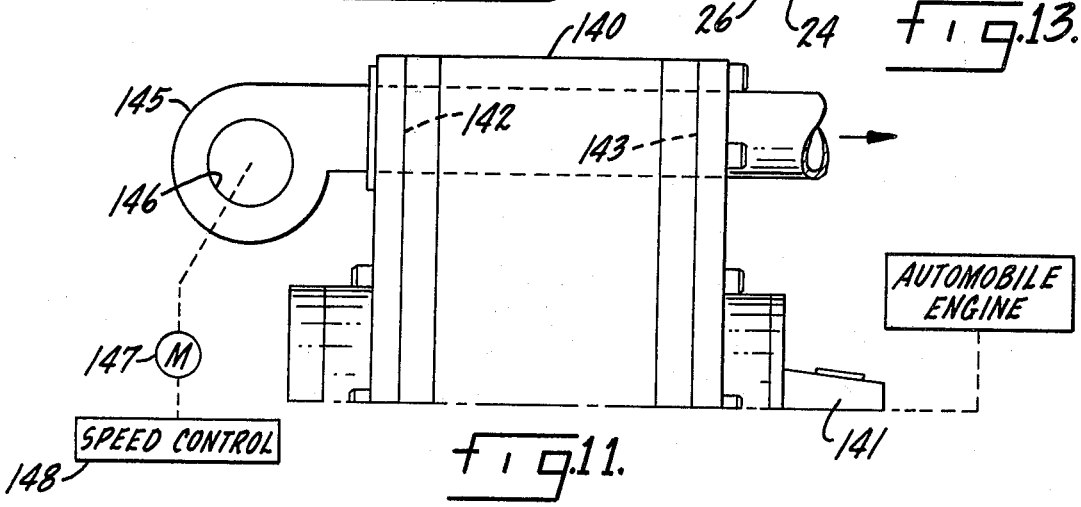
Fig. 11.

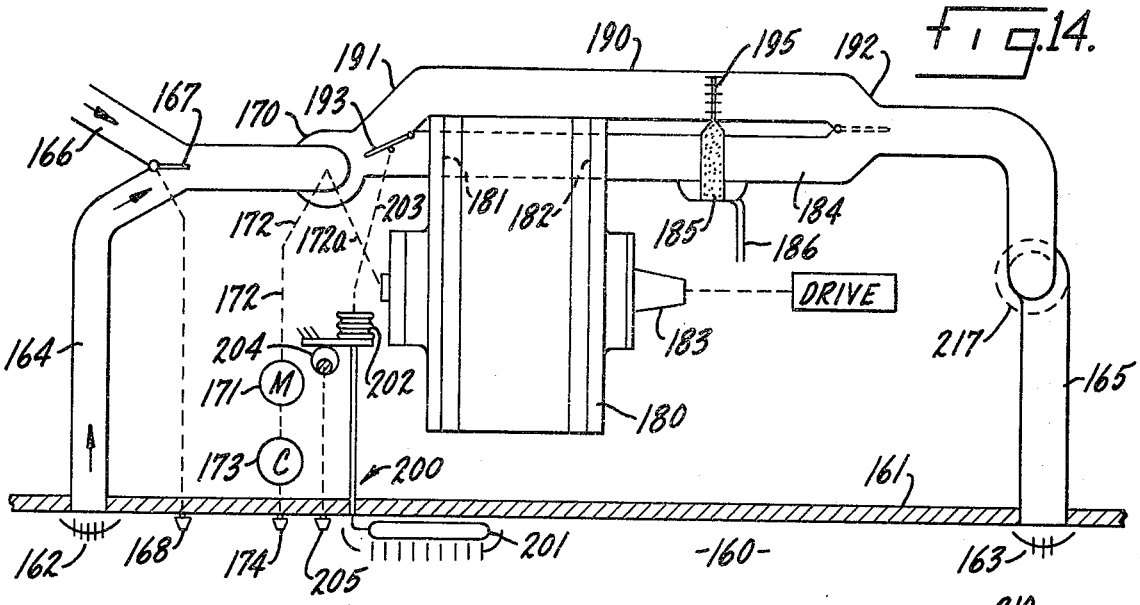
fig.14.
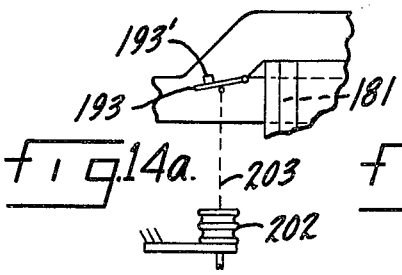
fig.14a.
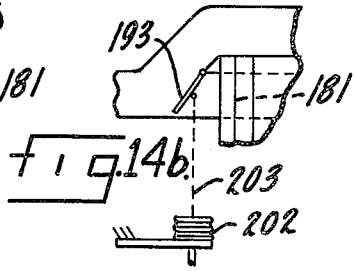
fig.14b.
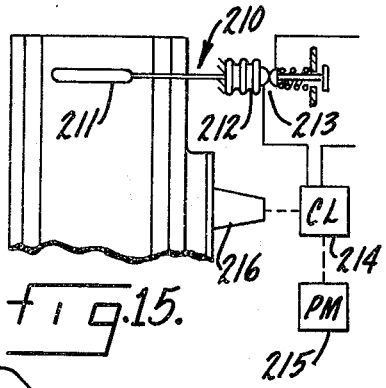
fig.15.
fig.16.
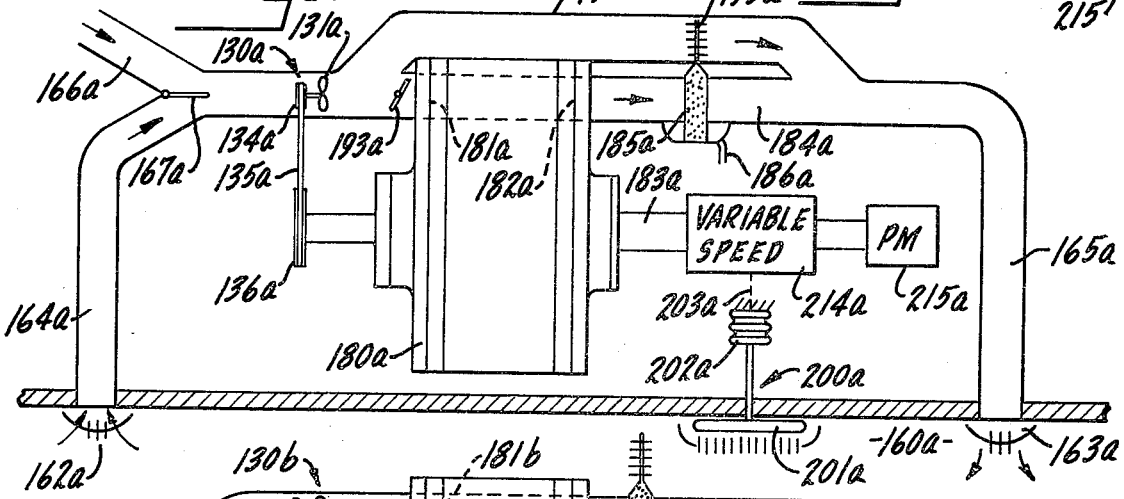
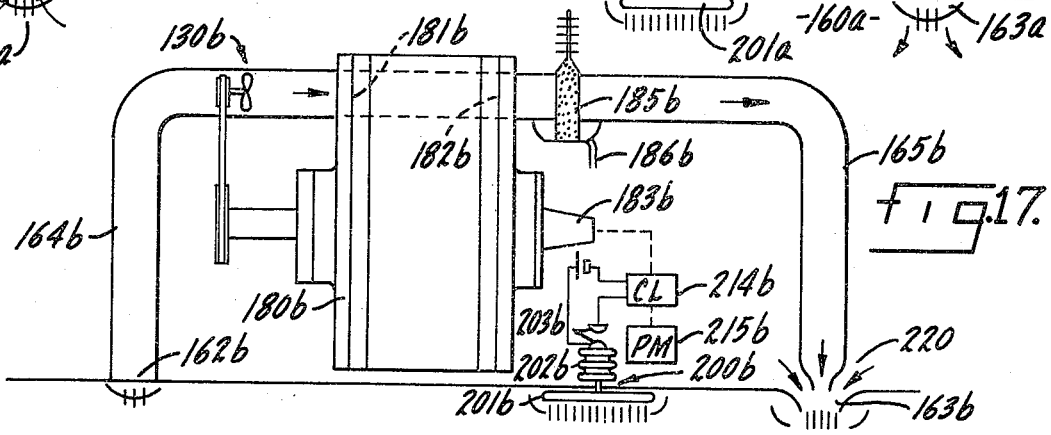
fig.17.

Fig. 18.
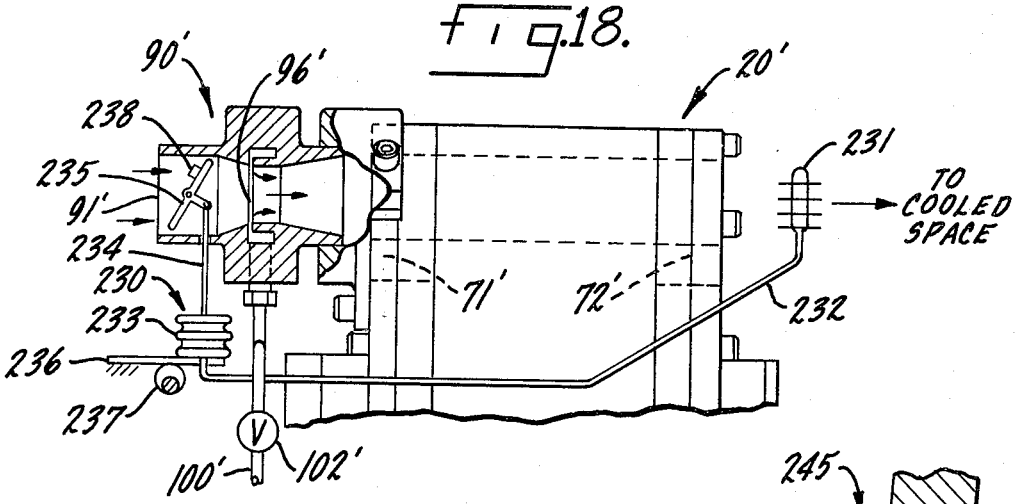
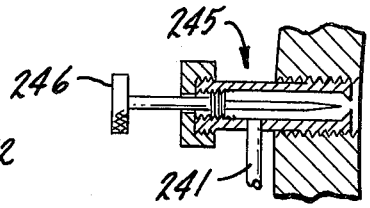
Fig. 19.
Fig. 19a.
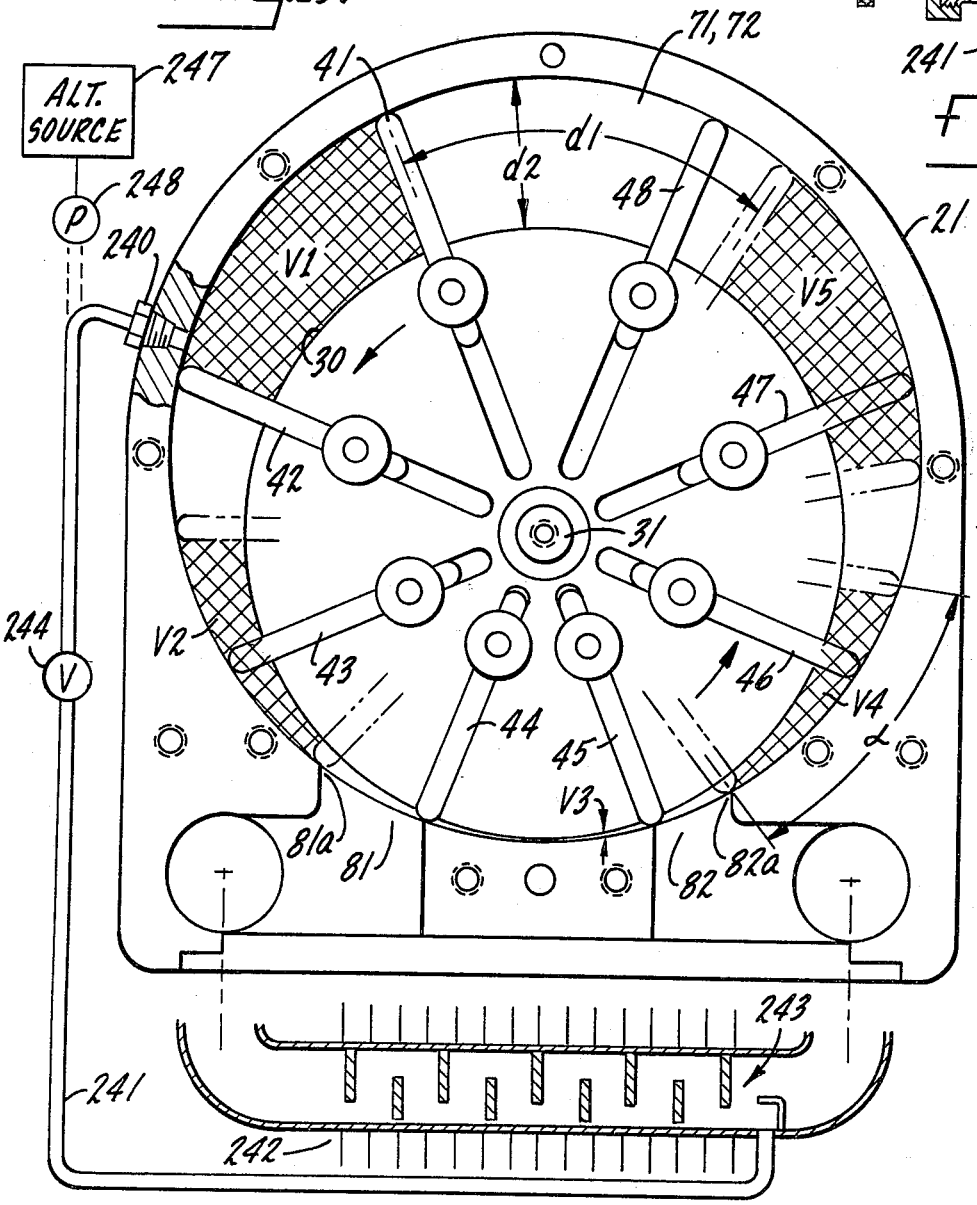

COMPRESSOR-EXPANDER WITH VOLUME COMPENSATION

This invention is directed to improvements in rotary vane compressor-expander devices combined with heat exchangers as disclosed in Edwards U.S. Pat. No. 3,686,893 to provide an improved system for carrying out a Reversed Open Brayton Air Cycle for air conditioning and refrigeration.

The stator of the rotary vane device illustrated in the Edwards patent has an elliptical chamber in which the rotor of the device is mounted. The manufacture of such a stator, and particularly the holding of required tolerances in machining of the elliptical chamber raises machining problems due to its geometry. Furthermore, in one complete revolution of the rotor every one of the vanes of the device must undergo two cycles of inward-outward movement which requires work to overcome the inertia upon change in direction.

In French Pat. No. 554,525, which issued in 1923, a rotary vane compressor-expander machine is disclosed which utilizes a circular chamber in which the rotor of its device is mounted. In that machine, refrigerant vapor is introduced into and discharged from the machine, and exchanged between the same intravane chamber and the heat exchanger, by scavenging. In the open air cycle system of said Edwards U.S. Pat. No. 3,686,893, the six processes or steps of the open air cycle: intake pumping (1), compression (2), pumping of hot compressed air to the heat exchanger (3), pumping of cooled compressed air from the heat exchanger (4), expansion (5), and outlet pumping of cold expanded air (6), are accomplished by positive displacement due to the interaction between the vanes and the chamber wall of the device. In the machine of French Pat. No. 554,525, only two processes: compression (2) and expansion (5) are carried out by positive displacement. The other four processes of the closed cycle are carried out by fan induced scavenging. Moreover, the closed system of said French patent requires a separate compressor in addition to the disclosed rotary vane machine to carry out the six processes of the refrigeration cycle.

Scavenging at the heat exchanger in the French machine lowers efficiency because of warm gas carryover and because momentum conversion is involved which is inherently less efficient than positive displacement processes. Furthermore, the exchange of hot compressed gas cooled compressed gas from the heat exchanger involves mixing of two fluids at different temperatures, which, it is well known, involves a direct gain in entropy. Such an entropy gain, by the second law of thermodynamics degrades performance and lowers efficiency.

However, the stator chamber is circular and the vanes of the machine shown in said French Pat. No. 554,525 travel through one cycle of inward-outward movement in one complete revolution of the rotor, which is a desirable feature.

It is now proposed to provide a rotary vane compressor-expander device combined with a heat exchanger to carry out a reversed open Brayton air cycle for air conditioning and refrigeration, which device employs a stator which a circular stator chamber to facilitate its manufacture and to improve the operating characteristics of the device. It is also proposed to improve the operational and functional characteristics of the system by incorporating instrumentalities to control over a wide range the entropy of the output air, thus enhancing the adaptability of the system to a wider variety of air conditioning and refrigeration applications.

In the preferred form of this invention, four processes of an open reversed Brayton air cycle are carried out by positive displacement: compression (2), pumping of hot compressed air to the heat exchanger (3), pumping of cooled compressed air from the heat exchanger (4), expansion (5). In this invention, the processes of: intake (1), and outlet (5) are carried out by externally induced scavenging. While scavenging to and from the heat exchanger would be highly undesirable because of the difficulties in scavenging without warm air carryover, any carryover of cold discharge air from the outlet to the inlet of the rotary unit where a scavenging process is utilized will serve to precool intake air and the carryover may be controlled to introduce a further control variable in the operation of the system. Furthermore, by providing volume compensation between the compression side outlet and expansion side inlet chambers connected to the heat exchanger, and positive displacement pumping of air through the heat exchanger, flow through the heat exchanger at substantially constant pressure is achievable without the aid of other devices, such as a separate compressor. Thus the present invention provides a system having improved operational and functional characteristics and lower cost of manufacture of the components as compared with the system and machine disclosed in the French patent; moreover, the herein described improvements also lower the cost of manufacture of the apparatus and provide operational and functional system characteristics enhancing the practicability for commercial use of the system of said Edwards U.S. Pat. No. 3,686,893.

It is, accordingly, an object of the present invention to provide a compressor-expander which employs a cylindrical chamber, which is economical to construct and maintain and which is utilized in such a way as to achieve a high coefficient of performance.

It is a related object of the invention to provide a compressor-expander which utilizes a unitary cylindrical chamber with scavenging of input and output air but which overcomes the problems inherent in the patented French machine and which have prevented such machine from being practically utilized during the period of fifty years since the machine was first disclosed. More specifically it is an object to provide a machine which is predicated on usage of one of the features of the French device but which adds thereto significant novel features to create what is in effect a new machine and system having greater simplicity, efficiency and practicality.

It is thus an object of the present invention to provide a compressor-expander having a cylindrical, vaned rotor eccentrically journaled in a cylindrical chamber to define compartments which go through maximum, convergent, minimum and divergent stages, with a heat exchanger interconnecting the convergent and divergent stages and with spaced inlet and outlet openings at the maximum stage with means for inducing flow of air through such openings. As a result, cold air is ejected from each successively presented compartment and replaced by a charge of warm air which is acted upon in the ensuring rotative cycle, the heat exchanger ports being so located that equal masses of air are fed into, and removed from, the heat exchanger in each rotor compartment, with the result that air passes through the heat exchanger at substantially constant pressure.

It is an object of the invention in one of its aspects to induce flow of air through the inlet and outlet ports using a jet for amplified air entrainment and with the jet being supplied with compressed air bled from the heat exchanger. In such embodiment the mass in each compartment on the compression side is caused to exceed the mass of air in each compartment on the expansion side by an amount equal to the mass of air bled during the transverse time of a vane.

It is a related object to provide a compressor-expander unit which utilizes means for inducing flow of air through the main inlet and outlet ports but in which the inducing means is so economically constructed as to not add substantially to the cost of the unit as compared to units of the non-induced flow type. Indeed, because of the simplified cylindrical construction and the reduction in accelerational forces, the disclosed unit may be constructed even more economically than prior units.

It is still another object to provide a compressor-expander which is capable of operating efficiently at a variable rotor speed and which includes means for varying the flow of scavenging air automatically in accordance with rotor speed.

It is yet another object of the invention to provide a construction of compressor-expander which includes means for producing induced flow through inlet and outlet ports susceptible to temperature control using simple thermostatic means and light control forces and which is well adapted to mixing of warm ambient air with the cold air to produce discharge at a tempered and comfortable temperature level.

It is a further object to provide an air conditioning system having improved provision for moisture removal.

Other objects and advantages of the invention will be apparent upon reading the attached detailed description and upon reference to the drawings in which.

Figure 5:
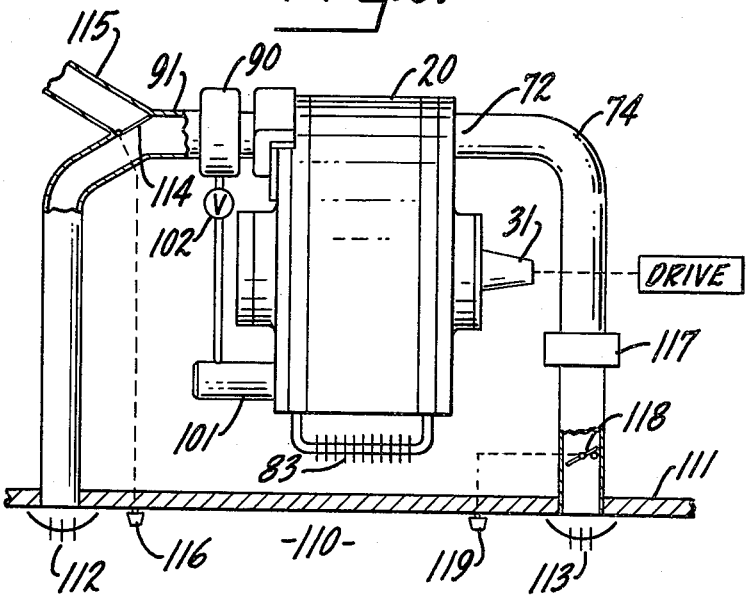
FIG. 5 is a diagram showing a typical automobile air conditioning system employing the unit disclosed in the above FIGS.
Figure 5A:
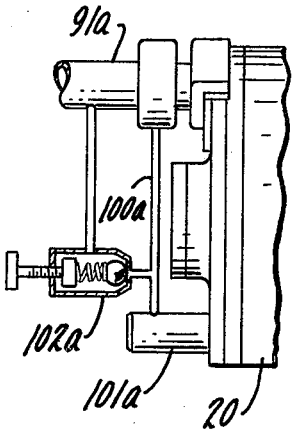

FIG. 5*a* is a diagram of a relief valve usable in the system of FIG. 5.

Figure 1:
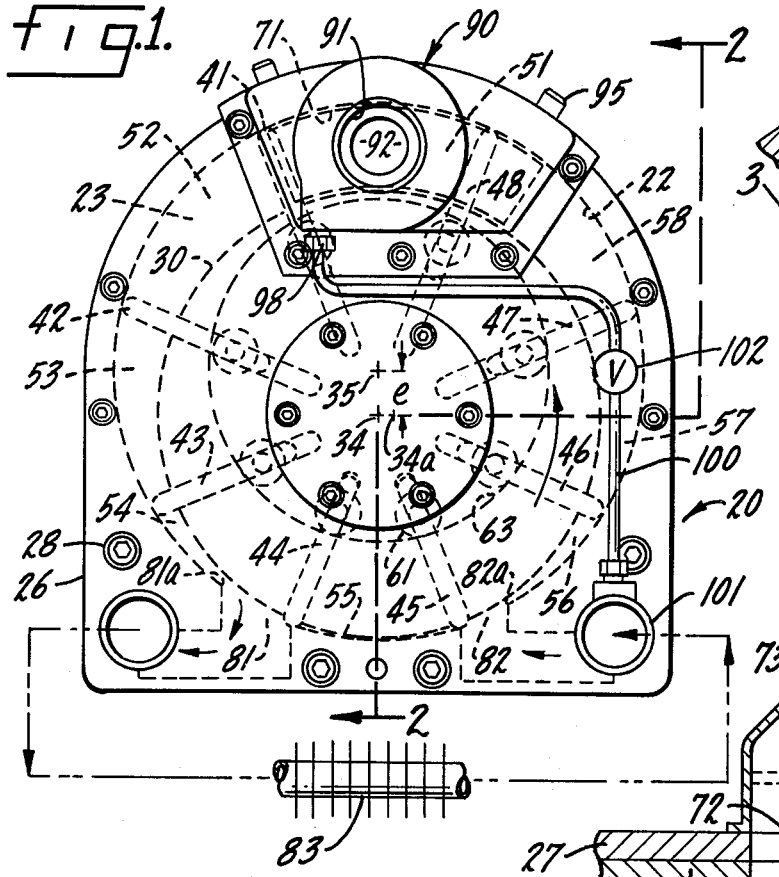
FIG. 1 is an elevational end view of a compressor-expander constructed in accordance with the invention.
Figure 6:
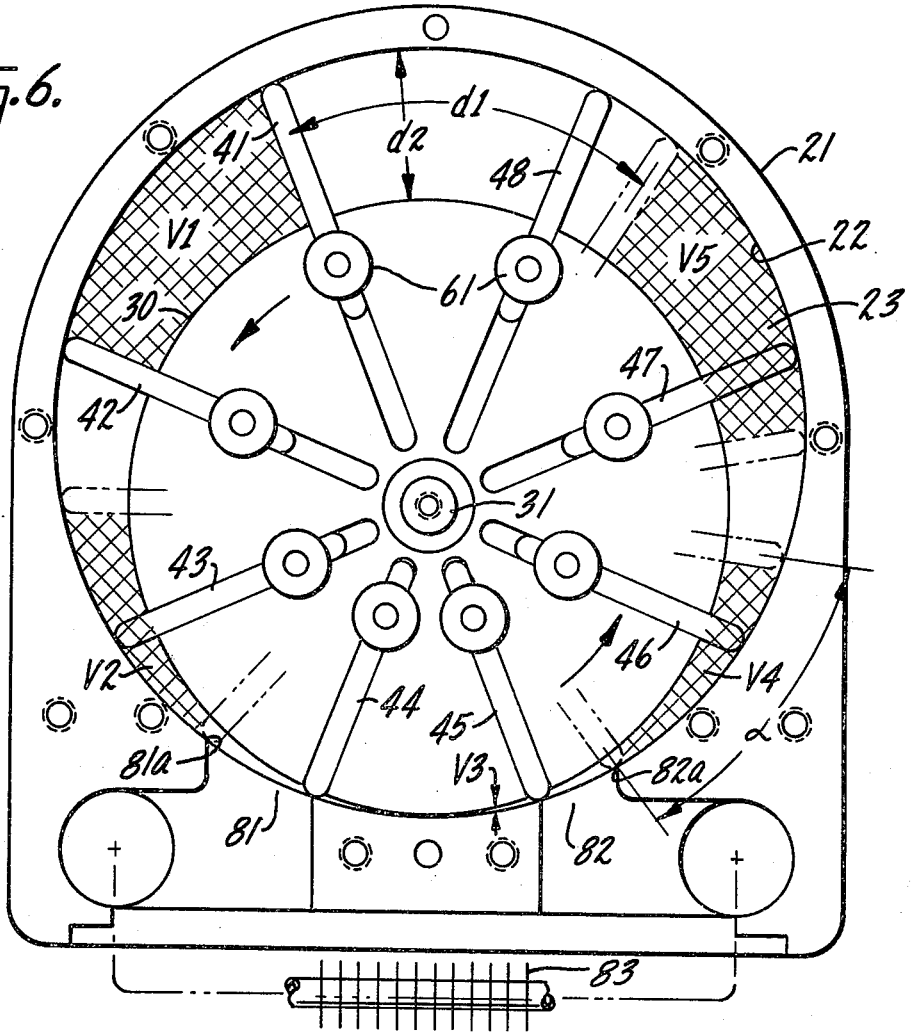

FIG. 6 is an elevational diagram similar to FIG. 1 but showing the variation in volume of the rotor compartments at significant points in the cycle.

Figure 2:
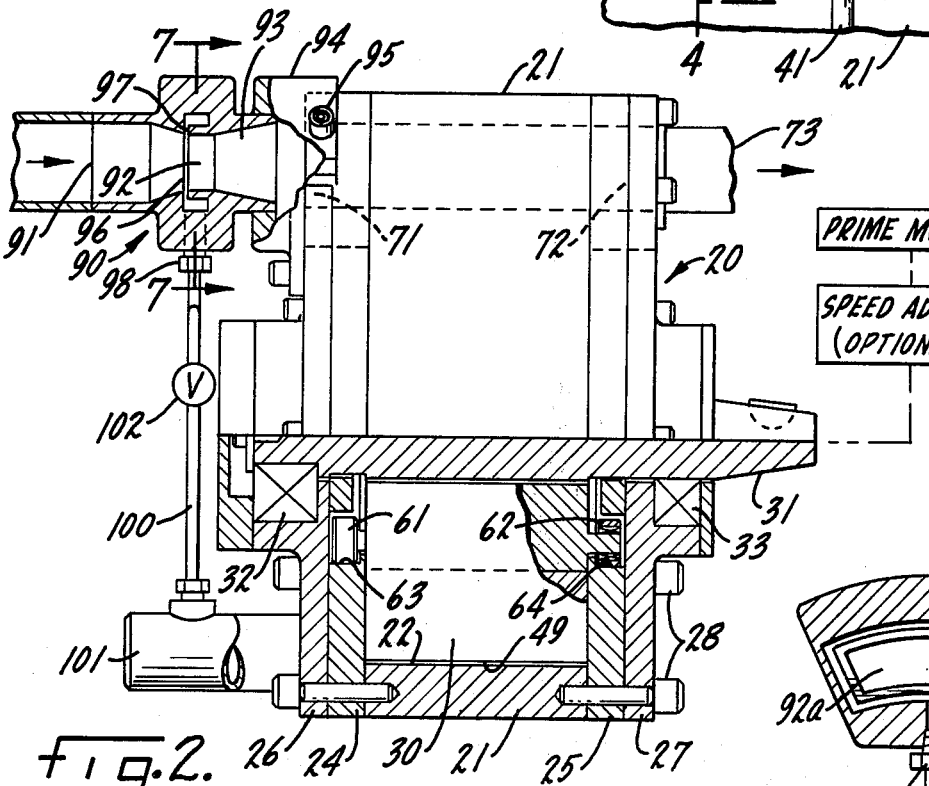
FIG. 2 is an elevational side view, in partial section, taken along line 2—2 in FIG. 1.
Figure 7:
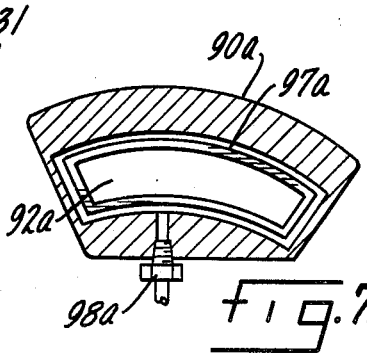

FIG. 7 shows a cross section of modified inductor unit taken along line 7—7 in FIG. 2.

FIG. 8 is a fragmentary view of the device employing an inductor at the outlet port.

FIG. 9 is a fragmentary end elevation showing use of a fan or blower powered from the rotor shaft.

FIG. 10 is a fragmentary side elevation corresponding to FIG. 9.

FIG. 11 is a fragmentary side elevation showing use of an adjustable separately driven blower.

FIG. 12 is a fragmentary top view of a modified unit showing the use of arcuate, radially directed ports in the housing and looking along line 12—12 in FIG. 13.

FIG. 13 is a section taken along line 13—13 in FIG. 12.

FIG. 14 is a diagram showing an automotive air conditioning system using the present compressor-expander unit having provision for diversion, moisture removal and condition control.

FIGS. 14*a* and 14*b* are diagrams showing the system calling for maximum cooling and reduced cooling, respectively.

FIG. 15 is a diagram showing use of an anti-freeze-up control usable with the system in FIG. 14.

FIG. 16 is a diagram showing use of the unit with diversion, moisture removal and automatic variable speed drive.

FIG. 17 shows a modified system similar to FIG. 16 but in which the tempering air is inducted at the vent.

FIG. 18 is a fragment showing constant temperature control.

FIG. 19 shows water injection in a scavenging type machine.

FIG. 19*a* illustrates a valve for use in the device of FIG. 19.

While the invention has been described in connection with certain preferred embodiments, it will be understood that I do not intend to be limited to the particular embodiments shown but intend, on the contrary, to cover the various alternative and equivalent forms of the invention included within the spirit and scope of the appended claims.

Turning now to the drawings there is disclosed, in FIGS. 1 and 2, a compressor-expander 20 having an annular frame 21 having a cylindrical inner surface 22 defining a chamber 23. The chamber is enclosed by annular cam plates 24, 25 on which are superimposed coverplates 26, 27, with the assembly being held together by axially extending screws 28.

Mounted within the cylindrical chamber 23 is a cylindrical rotor 30 having a shaft 31 mounted in anti-friction bearings 32, 33 which are secured, in alined position, in the coverplates. The axis of the rotor, indicated at 34 is eccentrically offset from the axis of the frame, indicated at 35 by an eccentric distance *e*.

Mounted in registered relation with slots in the rotor are a plurality of radially extending rotor vanes 41–48 inclusive, each vane being dimensioned to bridge the space between the cam plates 24, 25 and each having an outer edge 49 which operatively "engages" the cylindrical inner wall 22 of the frame preferably short of actual touching. The vanes define between them a series of compartments 51–58. Because of the eccentricity between the rotor and the compartment in which it is mounted, the compartments undergo a change in volume as the rotor rotates from a maximum volume stage 51 progressively through convergent stages 52–54 to minimum stage 55. Continued rotation causes the volume to pass through divergent stages 56–58, with the volume again changing progressively back to maximum stage 51.

For the purpose of guiding the vanes during the course of their bodily movement as the rotor rotates, while maintaining close clearance with respect to the wall 22, each vane has a pair of rollers 61, 62 (FIG. 2) which rotate in circular tracks 63, 64 formed in the respective annular cam plates 24, 25. A spring band, not shown, but which is disclosed in my co-pending application Ser. No. 400,965 filed Sept. 26, 1973 U.S. Pat. No. 3,904,327 may be provided for urging the vanes outwardly, that is, for keeping the rollers 61, 62 outwardly seated against their respective tracks.

In accordance with the present invention the frame of the device is provided with spaced inlet and outlet ports 71, 72 respectively which are alined with the maximum stage 51. The ports 71, 72 are of generally rectangular, somewhat arcuate shape, having a radial dimension (FIG. 4) which corresponds to the radial width of the maximum stage 51 and a peripheral length *d2* which preferably exceeds, by a small amount, the peripheral length of a compartment defined by adjacent vanes. It will suffice for the present to say that a charge of warm air in the maximum stage 51, upon undergoing a single revolution within the machine undergoes a drastic drop in temperature, the cold air being finally ejected, by scavenging action, through the outlet port 72.

The port 72 is coupled by means of a generally rectangular "transition" section 73 (FIG. 3) to a suitable outlet conduit 74.

In carrying out the invention, heat exchanger ports 81, 82 are provided near the final and initial limits of the convergent and divergent stages 54, 56 respectively. Interconnecting the heat exchanger ports 81, 82 is a heat exchanger 83 which may consist of a length of finned tubing through which air passes on its way from the convergent stage to the divergent stage and which is cooled by ambient air, either as a result of natural flow or by use of an auxiliary fan or blower (not shown).

In the operation of the device as thus far described, a charge of warm air blown into the inlet port 71 at the maximum stage 51 is compressed, as the rotor rotates, accompanied by an increase in temperature, as the charge passes through stages 52–54. The compressed, heated, air is discharged from the port 81 into the heat exchanger 83 where it remains at high pressure while its temperature is reduced. The compressed air, reduced now to substantially ambient temperature, is fed into the heat exchanger port 82 where, upon rotation of the rotor, it is permitted to expand in stages 56–58, the expansion taking place adiabatically to ambient pressure accompanied by a sharp drop in temperature. During the expansion process the force of the air acting upon the presented surfaces of the vanes drives the rotor, in the direction shown, in the manner of a motor, thereby subtracting energy from the compressed air and assisting the rotor drive to compress the air which is in the compartments on the compression side of the machine. In short, while energy is necessary to compress the air, much of this energy is returned during the expansion phase, thereby substantially reducing the net energy required to drive the machine.

Figure 3:
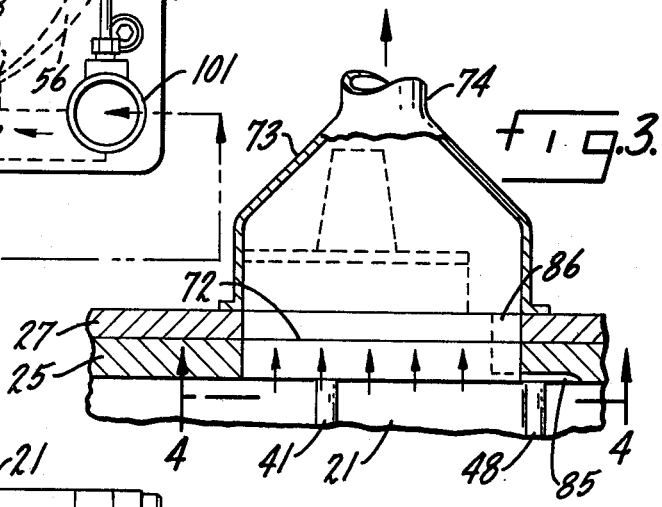
FIG. 3 is a fragmentary cross section to show the relief at the leading edge of the outlet port taken along line 3—3 in FIG. 4.

The positional phase of the "leading" edges 84 of the inlet and outlet ports 71, 72 (see FIG. 4), is such that when a vane, such as the vane 48, reaches the inlet and outlet ports the pressure in the compartment 58 defined by the vane 48 has been reduced to ambient pressure so that there is no outward, or inward, "puffing " of air through the ports 71, 72 by reason of the traverse of the vane 48 past the openings. To further insure equalization of the pressure within the compartment 58 and ambient pressure, the leading edge 84 may have an adjacent undercut or relief 85 which is profiled as shown in FIG. 3 to provide intentional leakage around the vane as the leading edge 84 is approached. If further equalization of output pressure is necessary, it may be achieved by use of a small filler block 86 which is indicated by the dot-dash profile, and which is of appropriate width.

Figure 4:
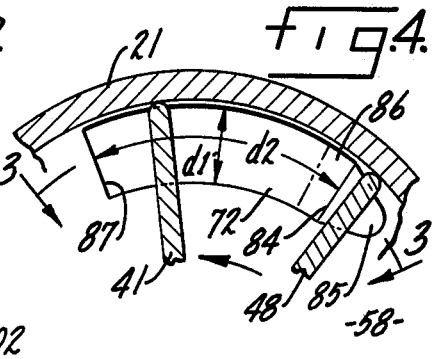
FIG. 4 is a profile view of the outlet port looking along line 4—4 of FIG. 3.

The amount of air trapped by each compartment traversing the ports 71, 72 is determined by the location of the trailing edge 87 (see again FIG. 4). Moving the edge 87 to the right increases the amount of air.

In accordance with the present invention means are provided for inducing the flow of warm air into the inlet port 71 for recharging of the rotor compartments and for scavenged discharge of the cold air at a predetermined rate which is related to the rate of movement of air in the compartments. More specifically in accordance with the invention means are provided for inducing flow of warm air into the inlet port 71 by means of an inductor or air flow amplifier in which a jet of compressed air derived from the machine itself serves, by the action of entrainment, to move a much larger volume of the warm air. Thus, referring to FIG. 2, an inductor 90 is provided having an inlet 91, a venturi throat 92, and a flaring outlet 93. The outlet 93 is coupled to the inlet port 71 of the compressor-expander by means of an adaptor or manifold 94 which is secured in place by means of screws 95. The throat 92 of the inductor is encircled by a jet-producing slit 96 defined by a lip 97 to which compressed air is supplied via a connection 98. The slilt 96, if desired, need not be continuous and may consist of a ring of closely spaced holes.

In accordance with one of the features of the present invention the pressure connection 98 of the inductor 90 is furnished with compressed air by bleeding off some of the compressed air which exists in the heat exchanger 83. Specifically, a small diameter pressure line 100 extends from a pressure manifold 101 associated with the heat exchanger to the connection 98 on the inductor, a valve 102, of the throttle type, being preferably interposed in the line to adjust the flow of bleed air for a given pressure condition in the heat exchanger. To preserve efficiency the cross section of the slit 96 is preferably so adjusted that under normal working conditions sufficient back pressure is developed to limit the rate of bleed to just that amount required for movement of induced air at the desired rate so that very little supplemental throttling is required.

The action of the inductor per se if readily understood. Pressurized air taken from the "cold" end of the heat exchanger 83 flows through the slit orifice 96, the latter being so formed that the air has an axial component, to the right as viewed in FIG. 2, entraining a large volume of ambient air which is in proportion to the rate of flow of the compressed air, the volumetric ratio being within the range of 5:1 to 15:1 depending upon the degree of obstruction, that is, back pressure, in the downstream path.

In a typical refrigeration system employing the present air conditioning unit, and shown in greatly simplified form in FIG. 5, the cooled compartment, indicated at 110, which may be the interior of an automobile, is separated from the ambient by a wall 111 providing a return connection 112 and an air vent 113. The inlet connection 91 of the inductor is connected, via a proportioning valve 114 alternatively to the return connection 112 and source of ambient air 115, with the proportion of returned air and ambient air being controlled by a fresh air control knob 116. Any desired means 117 may be used to remove the moisture in the cold air flowing through the outlet port 72. The air flow may, if desired, be throttled by a butterfly valve 118 having a control 119.

It will be apparent, then, that warm air from the return 112 or from the ambient 115, in desired proportion, is aspirated through the inductor 90 into the inlet port 71, filling the compartment at the maximum stage with warm air and discharging the cold air in such compartment through the outlet port 72, through the moisture removing device 117 and out of the vent 113 into the cooled space. The significant volumes of the compartments at the points of cut-off, and which are determined by the port locations, i.e., the locations of the port edges, are set forth in FIG. 6. The warm air deposited in the maximum compartment has a volume, at cut-off, equal to the volume VI in FIG. 6. The volume is reduced to the volume V2 by the time that a typical vane breaks contact at edge 81a of the heat exchanger port 81. The compartment volume is reduced, at the bottom point of the cycle, practically to zero as indicated at V3. Thus the air occupying the volume V2 is squeezed at a high pressure, inversely related to the change in volume, into the heat exchanger where the sensible heat of compression is dissipated. The air flows through the heat exchanger at substantially constant pressure and thence through the heat exchanger port 82.

In carrying out the present invention the ports 81, 82 and the rotor axis are so positioned that the volume of air, indicated at V4, trapped between adjacent vanes at the instant of cut-off is less than that which occupies the space V2. More specifically in accordance with the invention the edge 82a of the heat exchanger port 82 is located so that the volume V4 between adjacent vanes, at cut-off, contains the same mass of air as the volume V2 on the compression side, less any mass of air which is lost through the bleed conduit during a single compartment, or vane, traverse interval. The difference in volume is largely accounted for by the fact that the air which occupies the volume V4 is cooler, and hence by Charles law more dense, than the air occupying the volume V2. The illustrated location and dimensioning of the ports 81, 82, and the establishment of equal masses of air between adjacent vanes, less "bleed", which may be conveniently termed "compensation", insures that there will be no net build-up of air within the heat exchanger nor any net loss of air, so that air flows from the heat exchanger inlet 81 to outlet 82 at substantially constant pressure. If there is no "bleed", the heat exchanger may be sealed between its inlet and outlet requiring neither pressurized "make-up" of air by means of a separate compressor, nor, conversely, the venting of air. By the term "cut-off" as used herein is meant the instant that a vane leaves the edge 81a of port 81 or the instant a vane engages the edge **82*a* of port 82. If desired, the differential volumes (V4 less than V2) may be achieved by offsetting the rotor axis to the right, from 34 to 34*a* in FIG. 1.**

In accordance with one of the aspects of the present invention the amount of air which is bled through the pressurized line 100 to the inductor 90 is quantitatively taken into account in determining the differential volumes. Specifically, the edge **32*a* of the port 82 may be moved incrementally to the left, as viewed in FIG. 6 (or the rotor axis to the right), so that the volume V4 is further reduced by an amount equal to the volume of pressurized air which is bled off during the traverse time of a single vane, that is, the time required by the rotor to traverse an angle equal to 360°/v, where $v$ is the number of vanes, the angle being indicated at $\alpha$ in FIG. 6. Where the speed of the rotor is $s$ revolutions per unit of time, the time interval $t$ required for a vane to traverse the angle $\alpha$ becomes $1/s \cdot v$. Thus the volume V4 is, by predetermined location of the port edge 82*a*, reduced incrementally by the volume of air bled during the above-mentioned time interval $t$. It is, however, preferred to express the relationship between V2 and V4 in terms of mass, that is to say, the port edge 82*a* is, in accordance with the invention, so located that the mass of air represented by the volume V4 is less than the mass of air represented by the volume V2, at their respective temperatures, by an amount which is equal to the mass of air which is passed through the pressurized bleed line 100 during the time interval $1/s \cdot$ v. This relationship can be precisely adjusted in a number of ways. For example, means may be provided for variably adjusting the position of the edge 82*a*. It will, however, be more convenient to control the rate of bleed by fine adjustment of the throttle valve 102** in the pressurized bleed line so that the observed pressure in the heat exhchanger is constant, neither increasing nor decreasing upon passage of time.

It is one of the features of the construction disclosed in FIGS. 1–6 that air flow is jet-induced and that the pressure in the heat exchanger is constant. This condition can be met by substituting, for the auxiliary throttle valve 102, a simple form of relief valve **102*a* as illustrated in FIG. 5*a*. When a relief valve is used the device is preferably so designed, by moving the port edges 87, 81*a* slightly "upstream" to provide a slight excess of air into the heat exchanger. Any excess of air, resulting in increasing pressure, will cause the relief valve to yield to maintain a constant pressure in the heat exchanger and a constant pressure in the bleed line. As an alternate to connecting the relief valve 102*a* in "parallel" with the line 100*a* as shown in FIG. 5*a***, it may be connected in "series" with the line. The series arrangment is preferred where it is desired to maintain a predetermined constant pressure in the heat exchanger in systems where means other than an inductor is used to induce air flow.

As the rotor completes a cycle of rotation, the charge of air V4 between adjacent vanes expands to volume V5 which is, as previously discussed, preferably at ambient pressure to avoid puffing and its attendant noise as each vane (see 48 in FIG. 4) clears the leading edge 84 of the inlet and outlet ports 71, 72.

While the inductor 90 has been described of simple, circular form centrally positioned within the inlet, more prompt displacement of air and improved scavenging may be had by using two inductors side by side to more completely cover the inlet port. Moreover, it is not necessary that the inductor be circular, and it may have an elongated rectangular configuration to correspond to the annular shape of the maximum stage 51 which it supplies. Such alternate construction is indicated in the cross section view FIG. 7, where corresponding elements have been given corresponding reference numerals with addition of subscript *a*. Thus the inductor **90*a*, which is of enlarged cross section has an arcuate throat 92*a* defined by a lip 97*a* to which pressurized air is fed through a connection 98*a*. The construction shown in FIG. 7 provides a jet which produces bodily inward movement of a complete "slug" of warm air promptly displacing the corresponding slug of cold air through the outlet port 72** with prompt and complete scavenging of the walls.

While the invention has been described in connection with an inductor 90 feeding the inlet port 21 of the compressor-expander, it will be apparent to one skilled in the art that the inductor need not be located on the inlet side but many instead be associated with the outlet port 72 as shown in FIG. 8, corresponding reference numerals being employed in this figure with addition of subscript *b*. In short, the inductor is capable of inducing amplified flow regardless of its position in the air stream.

The use of an inductor receiving pressurized air from the rotor is particularly desirable in systems where the speed of the drive is relatively constant. However, in a typical automotive installation the compressor-expander may be belt driven from the automobile engine so as to operate at a rather indeterminant speed. In accordance with one of the features of the invention, therefore, means are provided for varying the rate of flow of warm air directly in accordance with the speed of the rotor thereby automatically maintaining a predetermined proportional relationship between the induced warm air and the cold are produced by the rotor. This is accomplished, as shown in FIGS. 9 and 10, by providing a rotary fan or blower which operates at a speed proportional to that of the rotor and which is preferably driven by the rotor. In these figures the compressor-expander, indicated at 120, driven by shaft 121, has an inlet port 122 and an outlet port (not shown) at the maximum stage. It will be understood that the construction of the compressor-expander including rotor and heat exchanger corresponds to that previously described. In accordance with the invention warm air is induced to flow through the inlet port 122 by means of a blower assembly 130 having a fan or impeller 131 mounted upon a shaft 132 which is journaled in an anti-friction bearing 133. At the end of the shaft is a pulley 134 driven by a V belt 135 which is trained about a drive pulley 136 on the shaft 121.

It will be apparent that by proper choice of pitch of the fan blades and proper drive ratio, the volume of warm air which is induced in the inlet port 122, per unit time, can be caused to equal the volume of cold air which is delivered by the vanes. Under such conditions of "equalized" flow, a slug of warm air will be delivered at the maximum stage 51 which is just sufficient to displace the cold air delivered between adjacent vanes so that there will be a substantially 1:1 replacement of the cold air with the warm. Under such conditions, and lacking recirculation, the temperature of the air at the outlet port will be a minimum, since there will be minimum mixing of the cold air with an excess of warm air, the term "excess" being defined as the amount of warm air which is induced into the maximum stage and which is more than is required simply to displace the cold air. If desired, however, the ratio between the driving and driven pulleys, for a given blade pitch, may be deliberately chosen to induce more than an equalized amount of warm air, that is, may be chosen to induce flow of warm air at a sufficient rate to insure that the cold air is completely scavenged and so that the temperature of the air at the outlet port is at a tempered, more comfortable level and at a rate greater than the rate of transport of the rotor.

In practicing the present invention it is not necessary that the flow of warm air be induced by bleeding of high pressure air or that flow of warm air be proportioned to rotor speed. On the contrary the rate of flow of warm air is susceptible to separate control as may be required in a number of important uses of the present machine. Thus referring to FIG. 11 which shows a further modification of the present device, the frame 140, having a driven rotor shaft 141, defines an inlet port 142 and an outlet port 143. Connected to the inlet port is a blower 145 which may be of the squirrel cage type having an inlet 146 and driven by a motor 147 at a rate determined by an adjustable control 148 providing constant air flow over widely varying engine speed.

In the embodiments of the invention previously deescribed the inlet and outlet ports have been formed in the end plates of the machine for "straight through", or axial, flow of the air. It will be apparent, upon inspection of FIGS. 12 and 13, that the invention is not limited to axial flow and that the annular portion of the frame indicated at 150 may be formed with axially spaced but radially directed inlet and outlet ports 151, 152. If desired such parts may be at least partly formed in the cam plates 24, 25. Warm air induced to flow through the inlet port 151 will scavenge axially as shown in FIG. 13 with the cold air exiting at port 152. Appropriate fittings will, of course, be required to makee contact with the arcuate land surfaces surrounding the ports, a matter which is well within the skill of the art.

While brief reference has been made, with respect to FIG. 5, to use of the device in a highly simplified refrigeration unit, it is one of the aspects of the invention to provide an air conditioning system having a degree of automated comfort control which exceeds that of conventional "freon" type systems and at only a fraction of the cost. Thus referring to FIG. 14 there is shown a system for conditioning a space 160 which is separated from the outer ambient by a wall 161. The wall has a return connection 152 and a vent 163 with associated conduits 164, 165. Fresh ambient air at a warm temperature is combined with returned air through a connection 166, with the proportion being adjustable by a vane 167 under the control of a fresh air control knob 168. The warm air mix is fed into a blower 170 driven by a motor 171 through a connection 712, the motor having a speed control 173 which is adjustable by a "volume control" knob 174.

Air from the blower is fed into a compressor-expander 180 having an inlet port 181, an outlet port 182 and shaft 183. The outlet port communicates with a conduit 184 having a porous filter 185 for catching particles of moisture, with the moisture in liquid form being drained from the device via a drain connection 186. With particles of moisture removed, the cooled air passes into the conduit 165. The filter 185 may, for example, consist of a mass of porous sintered metal.

In accordance with the present invention means are provided for bypassing a portion of the air from the blower around the compressor-expander 180 and its associated moisture removing filter 185, thereby permitting the filter to operate efficiently at a low temperature in removing the ice and water particles from the compressor-expander while, at the same time, permitting the dry, cold air to be mixed with a proportion of warm air so that the air discharged at the vent 163 is emitted in a tempered, comfortable state.

Thus in FIG. 14 there is provided a bypass connection 190 having an inlet 191 connected to the output of the blower and an outlet 192, the proportion of the warm, bypassed air being determined by the setting of a diverter vane 193. It is one of the features of the present invention that the cold air conduit 184 and bypass conduit 190 are arranged side by side and that the filter 185 in the conduit 183 is of the conductive type having a heat transfer element extending into the bypass conduit. The filter 185 may, for example, be formed of porous sintered metal having a conductive finned extension 195 which is acted upon by the bypassed air. Thus any particles of ice discharged at the outlet port 182 and which may become lodged upon the conductive filter 185 are promptly melted by heat which is transmitted through the thermal coupling element 195, with the resulting liquid moisture being vented through the drain line 186.

In accordance with one of the features of the invention, the diverter 193 may be thermostatically controlled. The thermostat, indicated at 200, has a bulb 201 and a bellows 202 having a mechanical connection 203 to the vane 193. The bellows is bodily adjustable by a cam 204 controlled by a temperature setting knob 205.

The operation of the temperature control means will be apparent upon considering two conditions, one in which the thermostat is calling for full cooling as set forth in FIG. 14*a* and the other in which the thermostat is calling for reduced cooling as set forth in FIG. 14*b*. Referring first to FIG. 14*a* it is assumed that the temperature in the cooled space 160 is excessive, causing the bellows to expand and thereby swinging the diverter vane 193 upwardly. This produces maximum flow through the compressor-expander while cutting down on the bypassed warm air thereby lowering the temperature of the air discharged at the vent 163. If desired, a stop 193' may be interposed in the path of movement of the vane 193 so as to limit the amount of warm air which is passed through the compressor-expander, keeping in mind that the filter 185 is most effective in entrapping particles of moisture when operated at low temperature. If desired, the stop 193' may be interposed at a point which will insure that the air which is discharged from the outlet port 182 will be below freezing temperature to secure maximum dehumidification at the filter 185.

Conversely, where the temperature in the closed space is lower than that for which the thermostat has been set, that is, where less cooling is called for, the bellows 202 will contract as shown in FIG. 14b causing more of the warm air to be bypassed. Simultaneously the closing off of the inlet port 181 by the vane or diverter 193 results in flow of warm air less than the "equalized" rate so that not all of the cold air is discharged but on the contrary some of the cold air is recirculated in the compressor-expander. The combined effect is to increase the temperature of the air flowing from the vent 163 so that the temperature in the cooled space is restored to the level to which the thermostat has been set.

Since recirculation of some portion of the cold air within the compressor-expander will cause the compressor-expander to become progressively colder, it is proposed, as one of the aspects of the present invention, that means be provided for responding to a drop in temperature of the frame of the compressor-expander to uncouple the compressor-expander from the prime mover, such as the automobile engine, which drives it. This is illustrated in FIG. 15 where a control thermostat 210 is provided having a bulb 211 in thermal contact with the frame of the device at the maximum stage and having a bellows 212 controlling a set of contacts 213. The contacts are in series with an electromagnetic clutch 214 interposed between the prime mover 215 and the shaft 216. Under normal conditions the temperature of the frame is at a safely high level, with the contacts 213 being closed and the clutch engaged. However, under conditions of possible recirculation of a portion of the cold air the temperature at the bulb 211 drops, contracting the bellows 212 and opening the contacts 213 to temporarily disengage the clutch, thereby preventing "freeze-up" of the compressor-expander. As soon as the frame is restored to normal temperature the clutch reengages. Because of the thermal inertia of the frame there will be no sudden change in output temperature when the clutch disengages and detenting may be built into the thermostat to prevent rapid cycling. It will be apparent, then, that closure of vane 193 to progressively cut off the flow through the inlet port 181 results in decreased cooling by a starvation effect with the unit being adequately protected by declutching.

The blower 170 has been described, in the system of FIG. 14, as connected to the inlet port 181. If desired, the blower may be located, instead, at position 217 in the outlet duct 165 without affecting the operation. Also, while the system of FIG. 14 has been described in connection with a separately driven blower 170, it will be aapparent that the drive connection 172 from the motor to the blower may be disconnected and a direct drive connection 172a from the blower shaft to the rotor shaft 183 may be substituted so that the rate of flow of the induced air is maintained proportional to rotor speed. Or, if desired, an inductor 90 may be used as disclosed in FIGS. 1–5.

It is one of the further aspects of the present invention that a variable speed coupling device may be interposed between the prime mover and the compressor-expander for variably driving the latter and for automatic control of the degree of refrigeration. Because of the similarity of the systems disclosed in FIG. 16 with that of FIGS. 14, 15, the same reference numerals are used, where applicable, with addition of subscript *a*. In the system of FIG. 16 a variable speed drive connection 214*a* is interposed between the prime mover 215*a* (automobile engine) and the compressor-expander 180*a*. The variable speed device 214*a* is under the control of a thermostat 200*a* having a bulb 201*a*, bellows 202*a*, and speed control member 203*a*. Induction of warm air is brought about by a blower assembly 130*a* having a blower element 131*a* with driven and drive pulleys 134*a*, 136*a* interconnected by a belt 135*a*.

In operation, any increase in temperature within the cooled space 160*a* causes the variable speed device 214*a* to increase the speed of the compressor-expander thereby increasing the cooling rate. When the temperature in the cooled space decrease, the driving speed of the compresor-expander will decrease in step until an equilibrium temperature is reached which will be stably maintained. If desired, for the sake of simplicity and economy, an electromagnetic clutch may be used as the variable speed device 214*a*, with the clutch being controlled by conctacts (not shown) operated by the bellows 202*a* to provide on-off control, that is, to drive the compressor-expander only when the thermostat calls for increased cooling. The fact that the blower assembly 130*a* is coupled to the shaft of the compressor-expander insures that when the compressor-expander is turned off, warm air will not be discharged through the vent 163*a*. The blower assembly 130*a*, it may be noted, may be connected at its inlet to the duct 164*a*, provided that entry and exit holes penetrate the duct for accommodating the runs of the driving belt. Or a snail type blower may be substituted.

A still further version of the system shown in FIG. 16 is illustrated in FIG. 17 where corresponding reference numerals have been indicated by the same reference numerals with addition of subscript *b*. In this version the bypass is omitted and tempering occurs by entrainment of warm air at the vent 163*b* as indicated at 220.

By making use of a circular chamber as contrasted with the chamber of elliptical section employed in U.S. Pat. No. 3,686,893, there is no need to radially accelerate the vanes and the energy utilized for such acceleration can be conserved. The lack of radial acceleration in the geometry disclosed in FIGS. 1 and 6 may be varified by considering the fact that the cylindrical chamber is stationary so that the outer edges of the vanes follow a circular locus which is stationary in space, notwithstanding the fact that the relation of individual vanes with respect to the rotor undergoes constant change. Because of the lack of radial acceleration there is no theoretically limiting speed so that the rotor speed may be substantially increased beyond that in the earlier patent with a proportional increase in output, that is, BTU rate. In this connection it may be noted that the invention is not limited to use of vanes which are relatively slidable with respect to the rotor; on the contrary, the invention is well suited, particularly at high speed, to use vanes of the "tilting" types, hinged to the rotor periphery, as disclosed in my co-pending application Ser. No. 492,885, filed July 29, 1974, U.S. Pat. No. 3,886,765 centrifugal force serving to keep the vanes in functional engagement with the cylindrical wall of the chamber.

Comparing the present device with that disclosed in French Pat. No. 554,525, the advantages, in the light of the above, are apparent. The operation is drastically improved since there is no possibility of mixing of air entering the heat exchanger with the air leaving the heat exchanger with resultant increase in entropy and loss of efficiency. Moreover, in the present device, scavenging between the inlet and outlet ports is entirely practical since any incidental mixture of inlet and outlet air which may occur during the scavenging process, rather than reducing efficiency, simply has a tempering effect, resulting in a larger volume of air being discharged and with the discharged air being at a more comfortable discharge temperature. In contrast with the French construction the applicant purposely avoids any scavenging at the heat exchanger ports since imperfect scavenging, and resulting mixture of air, at this point has a serious effect upon efficiency measured in terms of coefficient of performance of the unit. A further distinction over the French patent resides in the fact that in the French patent the heat exchanger ports are symetrically aligned, whereas in the present construction the heat exchanger ports are differentially located or, alternatively, the rotor axis is laterally offset so as to decrease the compartment volume on the divergent side with respect to the convergent side so that the heat exchanger operates at constant pressure. Significantly, no auxiliary fan or compressor, required in the device of the French patent, is required in the heat exchange loop of the present construction, resulting in a substantial simplification and a relative reduction in cost.

Indeed the volume differential, in addition to compensating for the change in density of the air occurring in the heat exchanger, may be further unbalance to compensate for the air which is withdrawn via a bleed line and that embodiment of the inventive structure in which a nozzle is employed for warm air entrainment.

The present construction constitutes an improvement over that in the French patent in the additional respect that substantially higher compression and expansion ratios can be achieved resulting in improved efficiency, in terms of coefficient of performance, as well as increasing the capacity, or BTU rate, of the machine.

While the invention has been described, in the jet-entrainment version, utilizing compressed air bled from the heat exchanger, and preferably from the cold end of the heat exchanger, the invention is not limited thereto and, if desired, the bleed line may penetrate the housing in a position adjacent a heat exchanger port, either in the convergent region V2 or in the divergent region V4.

The term "air conditioning" as used herein shall be considered synonymous with "refrigeration".

While it is one of the features of the disclosed device that a perfectly cylindrical and therefore easily formed chamber is used, the term "cylindrical" is not limited to perfect circularity.

It is one of the features of the refrigeration unit disclosed in FIGS. 1 and 2 that it may be adapted, with only minor modification, for direct production of tempered air at a thermostatically controlled temperature. Thus as shown in FIG. 18, the unit 20' having inlet and outlet openings 71', 72' is fed by an inductor 90' supplied with compressed air from the associated heat exchanger (not shown) via bleed line 100' and throttle valve 102'. The device is so proportioned and the throttle valve 102' so adjusted that the vent 96' is capable of entraining an excess amount of warm air through the inlet 91'. In carrying out the invention a thermostat 230 is provided having a bulb 231 located in the output stream, a capillary 232 and bellows 233. The bellows positions a valve actuator 234 connected to a butterfly valve 235 in the inlet port 91'. For adjusting the control point of the thermostat, the bellows is supported upon an adjustable mount 236 positioned upon a cam 237. The thermostatic feedback loop may be adjusted so that under equilibrium conditions sufficient warm air is drawn in to produce an outlet temperature at a comfortable, tempered level, for example, 65°. In the event the temperature tends to go below such value, contraction of the fluid in the thermostat causes the butterfly valve 235 to rotate clockwise in a direction to admit more warm air. Conversely when the outlet temperature rises, the butterfly valve rotates counterclockwise so as to admit less warm air to restore the temperature of the output air to the equilibrium level. If desired, a stop 238 may be interposed in the path of movement of the butterfly valve to insure entry of warm air at at least the equalized rate. If the stop is omitted the unit may be protected by a cut-out as shown in FIG. 15.

In the above embodiments it has been assumed that the only moisture in the system is that which is naturally present in the entering air. In my co-pending applications Ser. No. 465,841 filed May 1, 1974, now U.S. Pat. No. 3,913,351 and Ser. No. 559,063 filed Mar. 17, 1975 means are disclosed for spraying water in finely divided form into the stream of air entering the inlet port in order to improve the coefficient of performance of the unit and to increase its cooling capacity. Because of the fact that scavenging is an imperfect procedure for air displacement, so that some of the moisture would tend to be short-circuited directly through the outlet port, such scheme is not used in the present construction. However, in accordance with one of the aspects of the invention, means are provided for spraying water into the convergent volumetric stage at a point which is well separated from the minimum stage but nevertheless isolated from the air flowing through the inlet and outlet ports. This is illustrated in FIG. 19 which shows the structure of FIGS. 1 and 6 fitted with a spray nozzle 240 which is threaded into the wall of the housing for communication with the compartment VI and which is connected, by means of a conduit 241 to a heat exchanger 242 which is internally fitted, as indicated at 243 for water condensation and interception. The rate of feedback off water may be controlled by means of an interposed throttle valve 244. Alternatively, as shown in FIG. 19*a*, the flow rate may be controlled by a needle valve 245 interposed in the line 241 and having a manual control knob 246. It will be apparent that with the nozzle 240 located in the position shown, in which it is isolated from the air flowing through the inelt and outlet ports 71, 72, all of the injected moisture must follow the path of compression and none of the moisture can pass directly from the nozzle into the outlet port 72. Since a relatively high pressure which in a practical case may be on the order of thirty pounds per square inch, exists in the heat exchanger 242, the moisture which is condensed and intercepted in the heat exchanger is forcibly propelled through the feedback line 241 without necessity for an auxiliary pump. However, if desired, an alternate source of water 247 may be used having an auxiliary pump 248 for directly furnishing water to the nozzle 240.

I claim as my invention:

1. In an air conditioning unit for cooling a space, the combination comprising, a frame having an enclosed cylindrical chamber, a cylindrical rotor mounted in said frame for rotation about the central axis of said rotor, said central axis of rotation being eccentric relative to said cylindrical chamber, means for driving the rotor, vanes spaced about the rotor periphery and having their outer edges extending into functional engagement with the wall of said chamber to define a series of compartments which vary in volume upon rotor rotation through volumetric stages which are (a) maximum, (b) convergent, (c) minimum, and (d) divergent, the frame having inlet and outlet ports leading to said cylindrical chamber arranged at substantially equal radii and spaced for simultaneous communication with successively presented compartments at the maximum stage, means including an air pump for inducing flow of warm air through the inlet port to charge each successively presented compartment with warm air while blowing out cold air from such compartment through the outlet port substantially independently of centrifugal force, the frame having peripherally spaced heat exchanger ports near the final and initial limits of the convergent and divergent stages, respectively, a heat exchanger connected between the heat exchanger ports, the heat exchanger ports and rotor axis being so located that a smaller volume of air is defined between adjacent vanes at cut-off at the initial limit of the divergent stage than at cut-off at the final limit of the convergent stage, so that the warm air introduced through the inlet port is (1) compressed accompanied by increase in temperature through the convergent stage, (2) discharged to the heat exchanger, (3) pumped through the heat exchanger at substantially constant pressure, (4) reintroduced as cooled compressed air, (5) expanded and cooled through the divergent stage, and (6) scavenged as cold air through the outlet port, and conduit means for conducting cold air from said outlet port to the space to be cooled.

2. In an air conditioning unit for cooling a space, the combination comprising, a frame having an enclosed cylindrical chamber, a cylindrical rotor mounted in said frame for rotation about the central axis of said rotor, said central axis of rotation being eccentric relative to said cylindrical chamber, means for driving the rotor, vanes spaced about the rotor periphery and having their outer edges extending into functional eengagement with the wall of said chamber to define a series of compartments which vary in volume upon rotor rotation through volumetric stages which are (a) maximum, (b) convergent, (c) minimum, and (d) divergent, the frame having inlet and outlet ports leading to said cylindrical chamber arranged at substantially equal radii and spaced for simultaneous communication with successively presented compartments at the maximum stage, means including an air pump for inducing flow of warm air through the inlet port to charge each successively presented compartment with warm air while blowing out cold air from such compartment through the outlet port substantially independently of centrifugal force, the frame having peripherally spaced heat exchanger ports near the final and initial limits of the convergent and divergent stages, respectively, a heat exchanger connected between the heat exchanger ports so that the warm air introduced through the inlet port is (1) compressed accompanied by increase in temperature through the convergent stage, (2) discharged to the heat exchanger, (3) pumped through the heat exchanger in the pressurized state, (4) reintroduced as cooled compressed air, (5) expanded and cooled through the divergent stage, and (6) scavenged as cold air through the outlet port, and conduit means for conducting cold air from said outlet port to the space to be cooled.

3. The combination as claimed in claim 2 including means for varying the warm air inducing means thereby to control the rate of warm air flow for predetermining the temperature of the conducted air.

4. In an air conditioning unit for cooling a space, the combination comprising, a frame having an enclosed cylindrical chamber, a cylindrical rotor mounted in said frame for rotation about the central axis of said rotor, said central axis of rotation being eccentric relative to said cylindrical chamber, means for driving the rotor, vanes spaced about the rotor periphery and having their outer edges in functional engagement with the wall of said chamber to define a series of compartments which vary in volume upon rotor rotation through volumetric stages which are (a) maximum, (b) convergent, (c) minimum, and (d) divergent, the frame having spaced inlet and outlet ports leading to said cylindrical chamber and communicating with successively presented compartments at the minimum stage, means for inducing flow of warm air through the inlet port to charge the successively presented compartments with warm air and to scavenge the same compartments of cold air through the outlet port, the frame having peripherally spaced heat exchanger ports near the final and initial limits of the convergent and divergent stages, respectively, a heat exchanger connected to the heat exchanger ports, the heat exchanger ports being so located that a smaller volume of air is defined between adjacent vanes at cut-off at the initial limit of the divergent stage than at cut-off at the final limit of the convergent stage, so that the warm air introduced through the inlet port is (1) compressed accompanied by increase in temperature through the convergent stage, (2) discharged to the heat exchanger, (3) pumped through the heat exchanger at substantially constant pressure, (4) reintroduced as cooled compressed air, (5) expanded and cooled through the divergent stage, and (6) scavenged as cold air from said outlet port to the space to be cooled, the warm air flow inducing means being coupled to the rotor for opening in unison therewith so that upon any change in the speed of the rotor driving means the rate of flow of warm air correspondingly changes thereby to maintain the conducted air at a more nearly constant temperature.

5. In an air conditioning unit for cooling a space, the combination comprising, a frame having an enclosed cylindrical chamber, a cylindrical rotor mounted in said frame for rotation about the central axis of said rotor, said central axis of rotation being eccentric relative to said cylindrical chamber, means for driving the rotor, vanes equally spaced about the rotor periphery and having their outer edges extending into functional engagement with the wall of said chamber to define a series of compartments which vary in volume upon rotor rotation through volumetric stages which are (a) maximum, (b) convergent, (c) minimum, and (d) divergent, the frame having inlet and outlet ports leading to said cylindrical chamber and spaced for simultaneous communication with successively presented compartments at the maximum stage, means for inducing flow of warm air through the inlet port to charge each successively presented compartment with warm air while blowing out cold air from such compartment through the outlet port, the frame having peripherally spaced heat exchanger ports near the final and initial limits of the convergent and divergent stages, respectively, a heat exchanger connected between the heat exchanger ports, so that the warm air introduced through the inlet port is (1) compressed accompanied by increase in temperature through the convergent stage, (2) discharged to the heat exchanger under pressure, (3) pumped through the heat exchanger at substantially constant pressure, (4) reintroduced as cooled compressed air, (5) expanded and cooled through the divergent stage, and (6) scavenged as cold air through the outlet port, and conduit means for conducting cold air from said outlet port to the space to be cooled, the flow inducing means including a bleed line and nozzle for bleeding off pressurized air from adjacent a heat exchanger port and for forming a jet for entrained flow of the warm air.

6. The combination as claimed in claim 1 in which the means for inducing flow of warm air through the inlet port while blowing out cold air from the outlet portion is in the form of a blower capable of producing a rate of flow which exceeds the equalized rate, the blower having means for adjusting the flow from the equalized rate to a rate greater than the equalized rate so that excess warm air flows through the outlet port along with the cold air for raising the average air temperature at the outlet port to a more temperate and comfortable level.

7. The combination as claimed in claim 1 in which the means for inducing flow of warm air is in the form of a nozzle defining an air jet for inducing an amplified flow of air through inlet and outlet ports by entrainment, a source of pressurized air for feeding the nozzle, and means for controlling the rate of induced flow.

8. The combination as claimed in claim 1 in which the means for inducing flow of warm air is in the form of a nozzle defining an air jet for inducing an amplified flow of air through the inlet and outlet ports by entrainment, the nozzle being fed by pressurized air through a bleed conduit connected adjacent one of the heat exchanger ports.

9. The combination as claimed in claim 1 in which the means for inducing flow of warm air is in the form of a nozzle defining an air jet for inducing an amplified flow of air through the inlet and outlet ports by entrainment, and a bleed conduit connected to the cold end of the heat exchanger for supplying pressurized air to the nozzle.

10. The combination as claimed in claim 7, the nozzle being in the form of a slit having an adjacent venturi encircling the stream of air flowing through the inlet and outlet ports.

11. The combination as claimed in claim 9, the nozzle being in the form of a slit having an adjacent venturi encircling the inlet port for inducing flow of air into the inlet port.

12. The combination as claimed in claim 10 in which the frame includes end plates and in which the inlet and outlet ports are in the respective end plates in a substantial alinement with one another at the maximum stage, the inlet and outlet ports being of elongated arcuate shape having a radial dimension substantially equal to the radial dimension of the compartments at the maximum stage and having a peripheral dimension substantially equal to the peripheral dimension of the compartments, the nozzle being in the form of a slit of generally corresponding profile encircling the inlet port.

13. The combination as claimed in claim 2 in which the frame includes end plates and in which the inlet and outlet ports are in the respective end plates in a substantial alinement with one another at the maximum stage, the inlet and outlet ports each being of elongated arcuate shape having a radial dimension substantially equal to the radial dimension of the compartments at the maximum stage and having a peripheral dimension substantially equal to the peripheral dimension of the compartments.

14. The combination as claimed in claim 8 in which adjustable throttling means are interposed in the bleed conduit to adjust the rate of flow of the bled air to a rate which will cause substantially constant pressure to exist in the heat exchanger.

15. The combination as claimed in claim 9 in which a relief valve is interposed in the bleed conduit to maintain a substantially constant pressure in the heat exchanger corresponding to the setting of the relief valve.

16. The combination as claimed in claim 1 in which a relief valve is connected to the heat exchanger for maintaining a substantially constant and predetermined pressure therein corresponding to the setting of the relief valve and means for venting the relief valve in the induced air stream.

17. The combination as claimed in claim 1 including a throttle valve in the air stream for adjusting the rate of flow of induced air.

18. The combination as claimed in claim 6, the adjusting means being in the form of means for controlling the speed of the blower.

19. The combination as claimed in claim 1 including means for adjusting the rate of induced air flow, the adjusting means including a thermostat responsive to the temperature of the discharged air for correctively acting upon the adjusting means thereby to maintain the temperature of the discharged air at a preset level.

20. The combination as claimed in claim 19, the adjusting means including a thermostatic element in the cooled space and an associated throttling valve in the air stream for correctively adjusting the rate of induced air flow to maintain the air in the space at substantially constant temperature, and means for adjusting the set point of the thermostatic element.

21. The combination as claimed in claim 1 in which the inlet and outlet ports are of matching elongated arcuate cross section, in which inlet and outlet conduits of different cross section are provided for leading air respectively in and out, and in which connector means are interposed between the conduits and the ports for providing smooth transition to achieve scavenging free of substantial turbulent mixing of the air.

22. The combination as claimed in claim 1 in which the frame is in the form of an annulus enclosed by end plates and in which the inlet and outlet ports are arcuately formed in the annulus adjacent the end plates and in substantial axial alinement with one another at the maximum stage so that the warm air enters radially inwardly and the cold air is discharged radially outwardly.

23. The combination as claimed in claim 8 in which the heat exchanger ports are so located that the mass of air defined between adjacent vanes at the inlet port of the heat exchanger exceeds the mass of air defined between adjacent vanes at the outlet port of the heat exchanger by an amount equal to the mass of air passing through the bleed conduit during a time interval $t = 1/s \cdot v$, where $s$ is the rotor speed and $v$ is the number of vanes on the rotor.

24. The combination as claimed in claim 1 in which the inlet and outlet ports have conduits for communicating with a cooled space, the unit lying outside of the cooled space, and adjustable means associated with the inlet port for conducting to the inlet port a mixture of air from the cooled space and warm air from outside the cooled space in predetermined proportion.

25. In an air conditioning system for cooling a space, the combination comprising an air conditioning unit having a frame defining an enclosed cylindrical chamber, a cylindrical rotor mounted in said frame for rotation about the central axis of said rotor, said central axis of rotation being eccentric relative to said cylindrical chamber, means for driving the rotor, vanes equally spaced about the rotor periphery and having their outer edges in functional engagement with the wall of said chamber to define a series of compartments which vary in volume upon rotor rotation through volumetric stages which are (a) maximum, (b) convergent, (c) minimum, and (d) divergent, the frame having spaced inlet and outlet ports leading to said cylindrical chamber and communicating with successively presented compartments at the maximum stage, blower means for inducing flow of warm air through the inlet port to charge the successively presented compartments with warm air and to scavenge the same compartments of cold air through the outlet port, the frame having peripherally spaced heat exchanger ports near the final and initial limits of the convergent and divergent stages, respectively, a heat exchanger connected to the heat exchanger ports, the heat exchanger ports being so located that a smaller volume of air is defined between adjacent vanes at cut-off at the initial limit of the divergent stage than at cut-off at the final limit of the convergent stage, so that the warm air introduced through the inlet port is (1) compressed accompanied by increase in temperature through the convergent stage, (2) discharged to the heat exchanger, (3) pumped through the heat exchanger at substantially constant pressure, (4) reintroduced as cooled compressed air, (5) expanded and cooled through the divergent stage, and (6) scavenged as cold air through the outlet port, a vent in the cooled space, a first conduit for conducting cold air from said outlet port to the vent, means including a filter in the first conduit for removing particles of moisture from the air, a second conduit coupled to the blower means for conducting warm air to the vent and connected to bypass the air conditioning unit and the filter so that the air acted upon by the filter is at a low temperature while the air issuing from the vent is at higher more comfortable average temperature.

26. In an air conditioning system for cooling a space, the combination comprising, an air conditioning unit having a frame defining an enclosed cylindrical chamber, a cylindrical rotor mounted in said frame for rotation about the central axis of said rotor, said central axis of rotation being eccentric relative to said cylindrical chamber, means for driving the rotor, vanes equally spaced about the rotor periphery and having their outer edges in functional engagement with the wall of said chamber to define a series of compartments which vary in volume upon rotor rotation through volumetric stages which are (a) maximum, (b) convergent, (c) minimum, and (d) divergent, the frame having spaced inlet and outlet ports leading to said cylindrical chamber and communicating with successively presented compartments at the maximum stage, a blower connected to blow warm air through the inlet port to charge the successively presented compartments with warm air and to scavenge the same compartments of cold air through the outlet port, the frame having peripherally spaced heat exchanger ports near the final and initial limits of the convergent and divergent stages, respectively, a heat exchanger connected to the heat exchanger ports so that the warm air introduced through the inlet port is (1) compressed accompanied by increase in temperature through the convergent stage, (2) discharged to the heat exchanger, (3) pumped through the heat exchanger, (4) reintroduced as cooled compressed air, (5) expanded and cooled through the divergent stage, and (6) scavenged as cold air through the outlet port, a vent in the cooled space, a first conduit for conducting cold air from said outlet port to the vent and a second conduit connected directly from the blower to the vent for bypassing warm air around the air conditioning unit so that the air issuing from the vent is at a comfortable average temperature, means including a filter in the first conduit for removing particles of moisture from the air, and means in the second conduit for conducting heat to the filter.

27. The system as claimed in claim 26 in which means are provided for limiting the amount of excess warm air flowing through the inlet port to a point which will insure that the moisture in the air flowing from the outlet port is at least partially in the form of ice particles, and means for conducting heat to the filter to melt the ice particles.

28. The system as claimed in claim 26 in which the two conduits are arranged side by side, means for limiting the amount of excess warm air flowing through the inlet port to a point which will insure that the moisture in the air flowing from the outlet port is at least partially in the form of ice particles, the filter being formed of thermally conductive porous material, and heat transfer means in the second conduit for conducting heat from the warm air therein to the filter for melting the accumulated ice particles while transferring the heat of fusion of the ice to the air in the second conduit.

29. The combination as claimed in claim 1 in which means are provided varying the flow of air into the inlet port to a rate which is less than the equalized rate so that all of the cold air is not removed from the presented compartments with at least partial recirculation thereof within the unit, and means responsive to achieving a predetermined low limit temperature in said frame for temporarily disabling the driving means.

30. The combination as claimed in claim 1 in which the flow including means is coupled to the rotor to produce a rate of induced flow of air in accordance with rotor speed, a variable speed drive connection for varying the speed of the rotor, and means including a thermostat responsive to the air in the cooled space for correctively varying the speed of the drive connection to maintain a predetermined at temperature in the space.

31. The combination as claimed in claim 30 in which the variable speed drive connection is a clutch controlled by the thermostat and interposed between the driving means and the rotor.

32. The combination as claimed in claim 1 in which the leading edges of the inlet and outlet ports are so peripherally positioned that the air in a compartment defined by a pair of vanes discharging into the maximum stage is at substantially ambient pressure when the leading vane of the pair encounters the leading edges of the ports thereby to inhibit puffing of air with respect to the compartment and its attendant noise.

33. The combination as claimed in claim 32 in which the chamber defined by the frame is formed with a shallow clearance space adjacent the leading edge of at least one of the openings thereby to provide a path for preliminary intentional leakage of air around the leading vane as the leading vane approaches the opening to equalize the pressure in the compartment and the pressure at the openings to minimize puffing of air with respect to the compartment and its attendant noise.

34. The combination as claimed in claim 2 in which the rotor axis is offset laterally in the direction of the divergent stage to decrease the volume of the compartments in the divergent stage relative to the volume of the compartments in the convergent stage.

35. The combination as claimed in claim 1 in which the driving means is an automobile engine and in which the flow inducing means is in the form of a blower having a driving motor operated at a constant but adjustable speed so that the rate of air flow to the space to be cooled remains constant in spite of wide variations in engine speed.

36. The combination as claimed in claim 1 in which means are provided for spraying water into the convergent volumetric stage at a point which is well separated from the minimum stage but isolated from the air flowing through the inlet and outlet ports.

37. The combination as claimed in claim 36 in which means are provided in the heat exchanger for condensing and accumulating the water and in which a water feedback conduit is connected between the heat exchanger and the spraying means for conducting water thereto under the influence of the pressure existing in the heat exchanger.

* * * * *